US005975784A

United States Patent [19]

Whaley

[11] Patent Number: 5,975,784

[45] Date of Patent: Nov. 2, 1999

[54] BOLT ACTION RING BINDER

[75] Inventor: Paul Whaley, Jefferson County, Mo.

[73] Assignee: U.S. Ring Binder Corporation, St. Louis, Mo.

[21] Appl. No.: 08/991,165

[22] Filed: Dec. 16, 1997

[51] Int. Cl.[6] ..... B42F 3/04

[52] U.S. Cl. ..... 402/34; 402/31; 402/38; 402/41

[58] Field of Search ..... 402/26, 27, 29, 402/31, 32, 33, 34, 36, 41, 42, 45

[56] References Cited

U.S. PATENT DOCUMENTS

| | | | |
|---|---|---|---|
| 1,299,276 | 4/1919 | Whitlock | 402/34 |
| 2,081,372 | 5/1937 | Thomas | 402/41 |
| 2,179,627 | 11/1939 | Handler | 402/32 |
| 3,255,759 | 6/1966 | Dennis | 402/34 |
| 3,333,592 | 8/1967 | Huffaker | 402/34 |

*Primary Examiner*—Willmon Fridie, Jr.
*Attorney, Agent, or Firm*—Polster, Lieder, Woodruff & Lucchesi

[57] ABSTRACT

A ring binder (10) stores hole (H) punched sheets of paper (P). A mechanism (16) is a bolt action mechanism which positively locks binder rings (18) which hold paper in its stored position. Each binder ring includes a fixed section (20) and a movable section (22). All of the movable binder ring sections are commonly mounted on a bolt (36) and move in unison with the bolt. A manually operable lever (38) is secured to one end of the bolt. When the lever is moved in one direction, the bolt is rotated so to move the movable sections of the binder rings away from the fixed sections and open the binder. Operation of the lever in the opposite direction brings the movable sections back into contact with the fixed sections to close the binder.

12 Claims, 4 Drawing Sheets

BOLT ACTION RING BINDER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to ring binders, and more particularly, to a ring binder incorporating a bolt action apparatus for opening and closing the binder to store and access hole punched materials with which the binder is used.

As is well-known in the art, a ring binder has two or more binder rings each of which comprises two sections which are movable into and out of contact with each other to open and close the metal. Most ring binders employ some type of lever mechanism which is manually operable by the user of the binder to move pull the ring sections apart. While the lever mechanism is also operable to push the sections together, most people simply close the rings by exerting finger pressure on the two sections. Many people also open the binder rings by pulling them apart with their fingers.

It sometimes happens that the amount of hole punched paper stored in the binder is so great that the volume of paper cause the rings to become partially spread apart when it is intended that the binder be fully closed. In such circumstances, it is not uncommon that even a slight additional pressure will cause the rings to open and paper to spill out. Various attempts have been made to design a fabricate a ring metal which prevents this from happening. Such constructions have met with different degrees of success. The apparatus of the present invention provides a novel solution to this problem which effectively maintains a binder closed and is not susceptible to the occurrence of spills. Unlike prior art release mechanisms which use levers, and the like, the ring binder of the present invention employs a simple, easy to use, fail safe mechanism.

BRIEF SUMMARY OF THE INVENTION

Among the several objects of the present invention may be noted the provision of a ring binder for use in storing hole punched sheets of paper or the like;

the provision of such a ring binder to employ a bolt action mechanism for operatively opening and closing the binder to store and access material in the binder;

the provision of such a ring binder to have a series of binder rings which capture the hole punched material for storage in the binder;

the provision of such a ring binder wherein each binder ring includes a fixed section and a movable section, each of the movable sections of the rings being commonly connected to the bolt action mechanism so movement of the mechanism simultaneously moves all of the movable binder ring sections;

the provision of such a ring binder in which the bolt action mechanism is movable from either end of the binder;

the provision of such a ring binder which positively closes the binder rings and does not allow the rings to be pulled apart by forces such as the weight of paper against the rings;

the provision of such a ring binder in which the bolt action mechanism is a low cost, easy to install assembly;

the provision of such a mechanism which is usable with different size ring binders and ring binders having different numbers of binder rings; and, the provision of such a mechanism which operates easily and reliably.

In accordance with the invention, generally stated, a ring binder is for storing hole punched sheets of paper or the like. A ring binder mechanism for the binder is a bolt action mechanism which positively locks binder rings which hold the paper in its stored position. There are a plurality of such binder rings, each of which includes a fixed section and a movable section. All of the movable binder ring sections are commonly mounted on a bolt so as to move in unison with the bolt. A manually operable lever is secured to one end of the bolt. When the lever is moved in one direction, the bolt is rotated so to move the movable sections of the binder rings away from the fixed sections, thus opening the binder. Operation of the lever in the opposite direction brings the movable sections back into contact with the fixed sections to close the binder. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
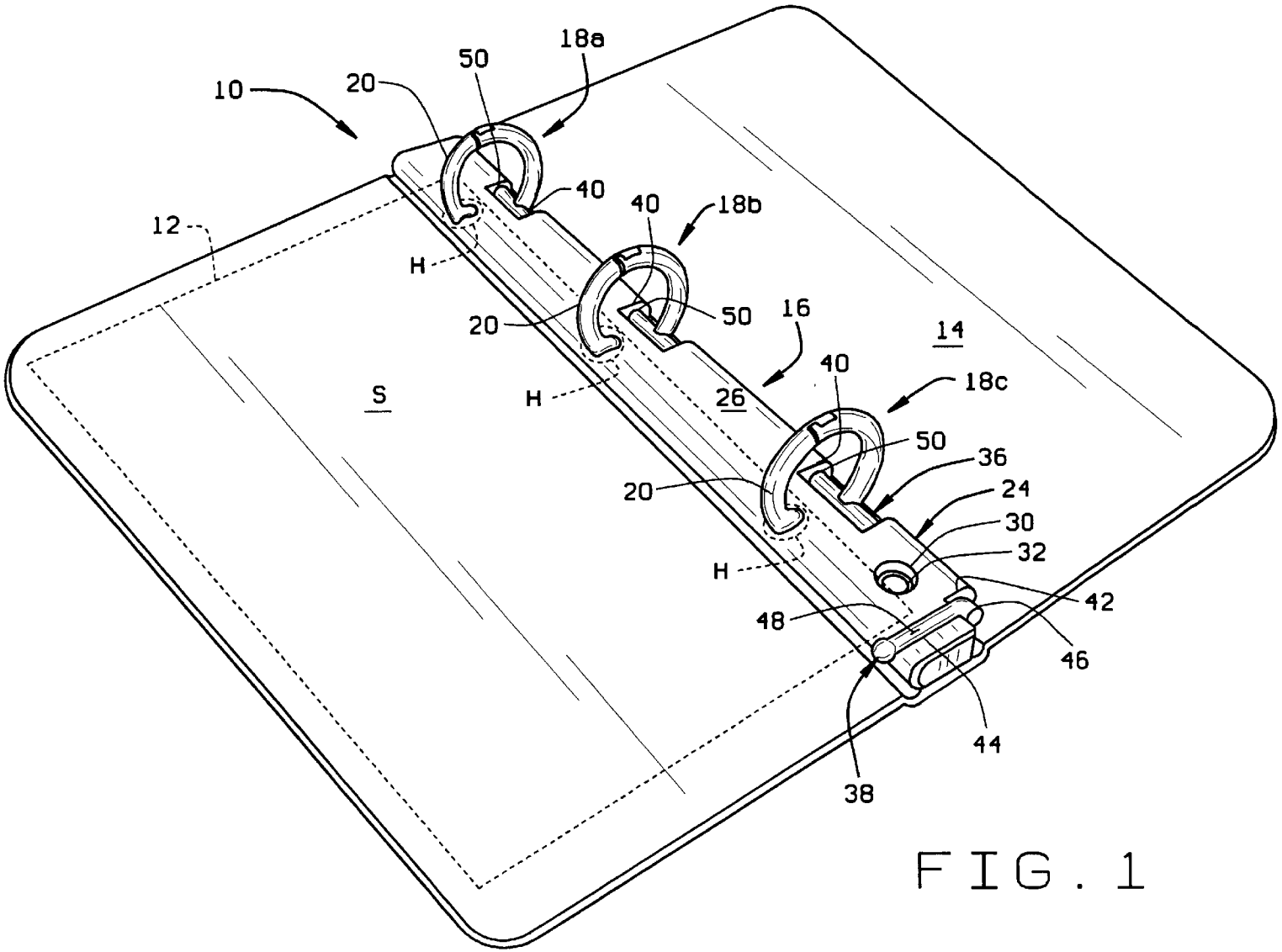
FIG. 1 is perspective view of a ring binder of the present invention.

Referring to the drawings, a ring binder of the present invention is indicated generally 10 and is for use in storing sheets S of paper having punched holes H in them. Binder 10 includes first and second end leafs 12, 14 respectively forming outer covers of the binder. The leafs are generally rectangular in shape and may be made of any suitable material. The length and width of the leafs are a function of the size of paper a particular binder 10 is intended to store. Next, a binder ring mechanism indicated generally 16 is positioned intermediate the respective end leafs, and the inner end of each end leaf is attached to the binder ring unit as described hereinafter. Heretofore, instead of mechanism 16, a ring metal comprising an elongate or rectangularly shaped metal plate (not shown) has been used with the end leafs attached to the center plate and the center plate, in turn, attached to a spine portion of the binder by rivets or the like. Binder rings (also not shown) used with the ring metal have been two piece rings each of which is separately movable to open and close the binder.

Figure 3:
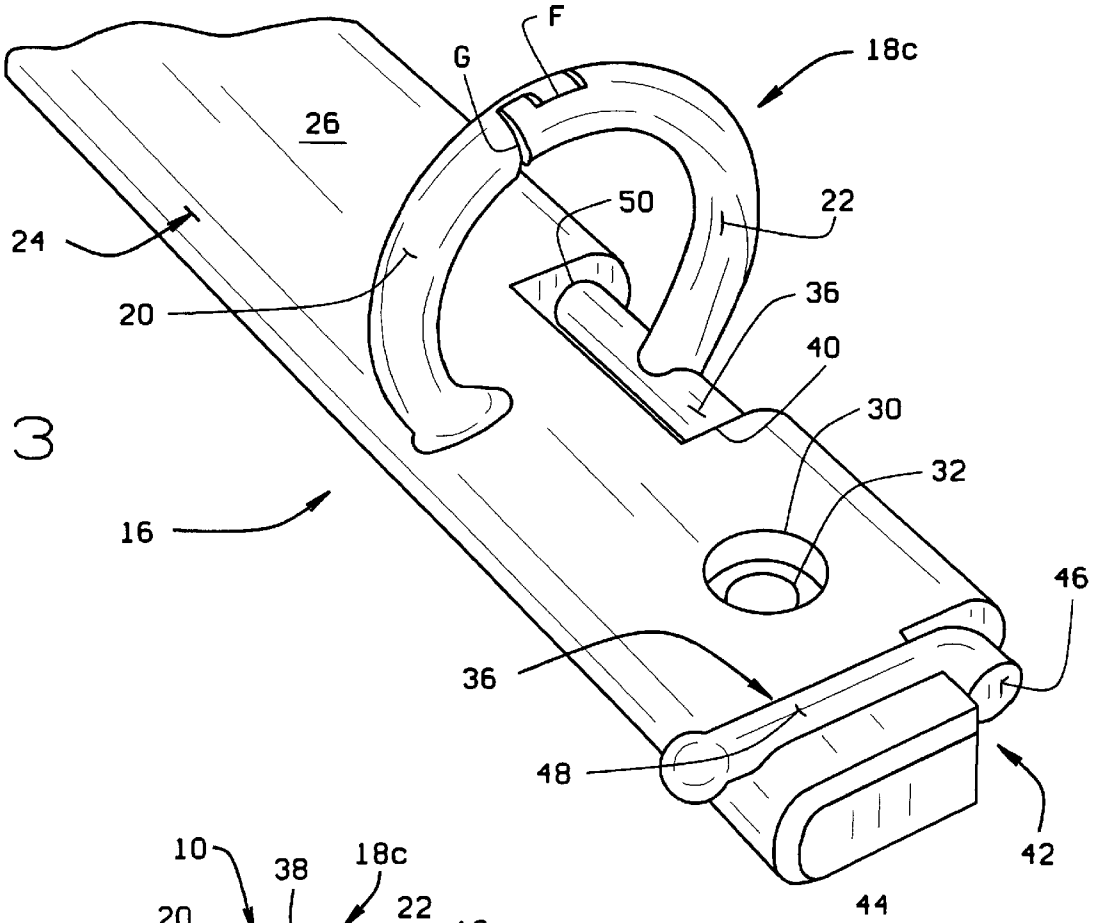
FIG. 3 is an enlarged broken away perspective view of the bolt action mechanism of the binder for holding hole punched sheets of paper in place.
Figure 2:
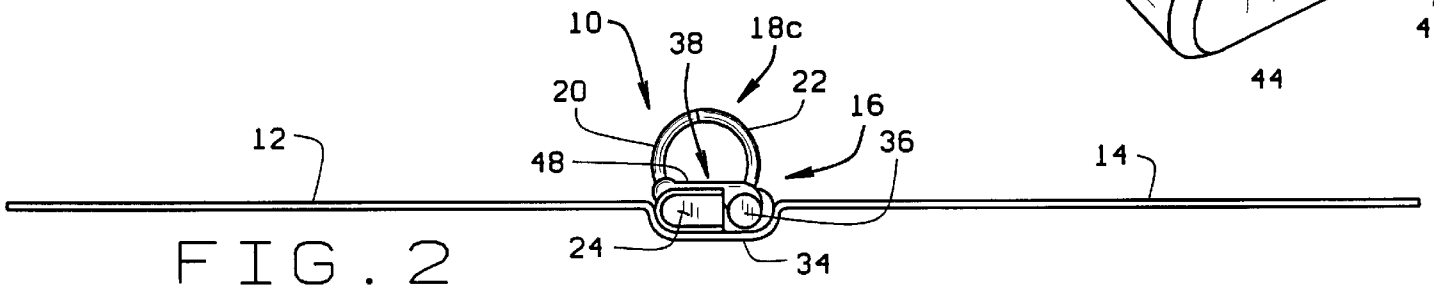
FIG. 2 is an end elevational view of the binder.

Mechanism 16 first includes a plurality of binder rings 18 which hold the sheets S in their stored position. In the drawings, three binder rings 18*a*–18*c* are shown. It will be understood by those skilled in the art that binder 10 may have more, or fewer, binder rings 18 without departing from the scope of the invention. Regardless of the number of binder rings a binder may have, each binder ring has fixed section 20 and a movable section 22. As described hereinafter, ring binder mechanism 16 positively locks the binder ring sections together to hold the sheets in their stored position against forces tending to open said binder rings. As shown in the drawings, fixed section 20 of each binder ring has a flat portion F formed adjacent its distal end, and a groove G formed at the inner end of the flat. Movable section 22 has a lip L which fits into groove G when the sections are brought together to close the binder. That is, the outer ends of the fixed and movable binder ring sections interlock with each other as shown in FIGS. 1 and 3.

Mechanism 16 includes a housing 24 the length of which generally corresponds to the height of binder 10. The housing, which may of a molded plastic material or a metal stamping, has a top surface 26. Fixed sections 20 of the binder rings 18 are affixed to this top surface. The sections 20 may be integrally formed with the housing; or, the sections may have a tab or projection (not shown) by which the ring section is fitted into one of a series of spaced openings 28 formed in the top of the housing and extending along one side of the housing. The openings 28 are uniformly spaced along the top of the housing. Also formed in top surface 26 of the housing, at each end of the housing, is a recess 30. A rivet (not shown) is inserted through an opening 32 in recess 30 for attaching the housing to a spine portion 34 of the binder.

Figure 4:
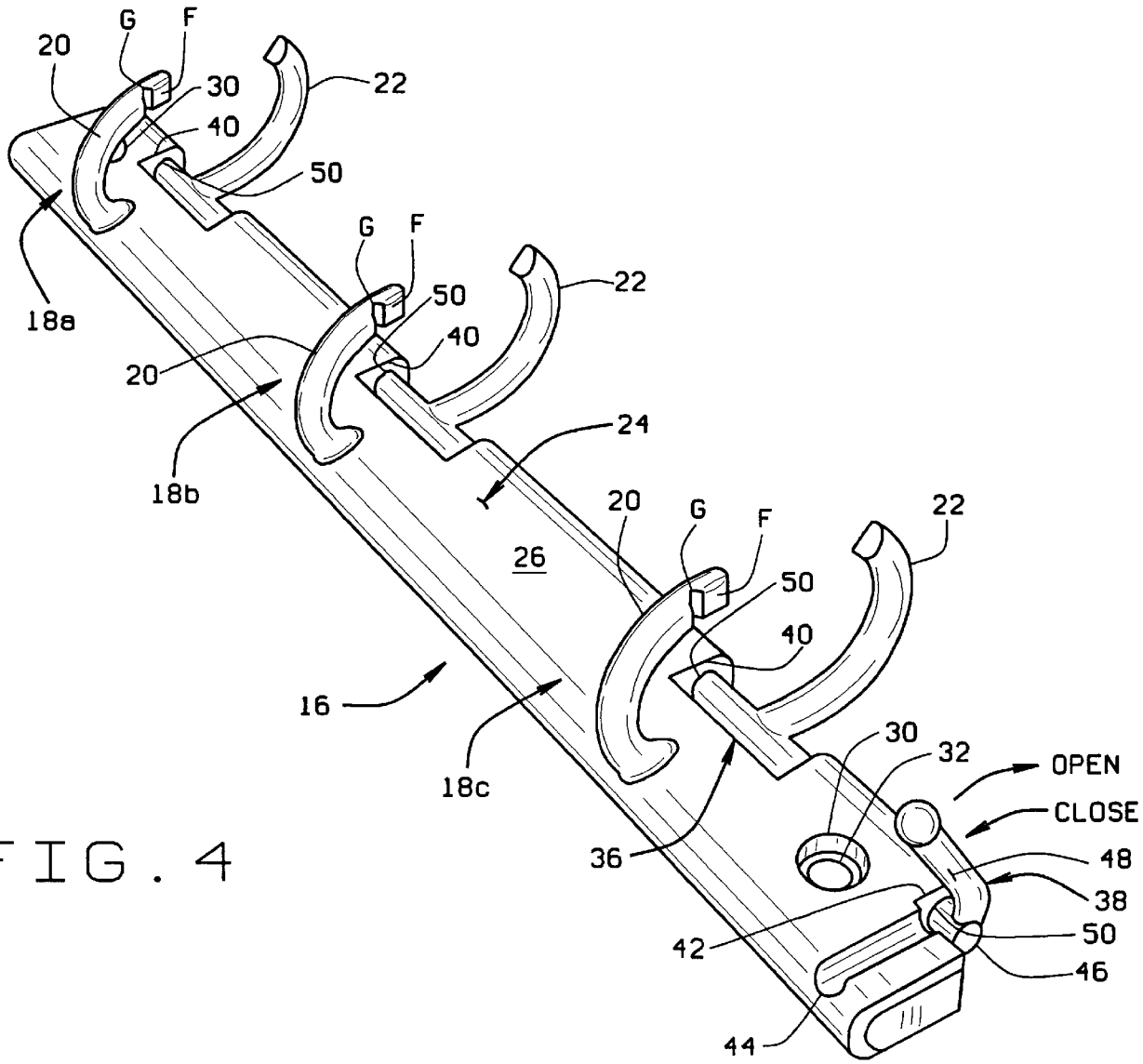
FIG. 4 is a perspective view of the mechanism in its binder open position.
Figure 6:
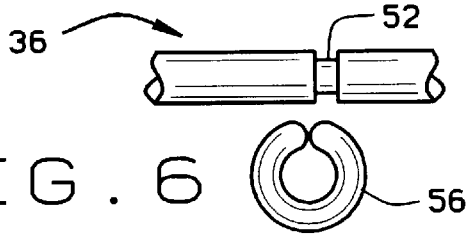
FIG. 6 is a partial view of a bolt used in the mechanism with a clip used to secure the bolt in the housing.
Figure 8:
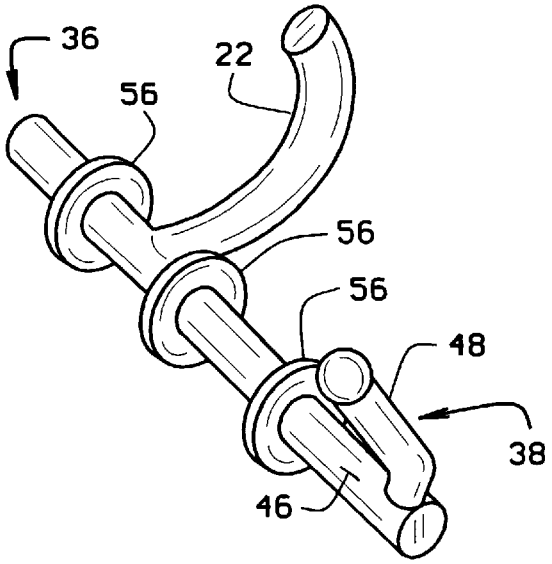
FIG. 8 is a perspective view of a portion of the bolt illustrating ring formed on the bolt for securing the bolt in place in the housing; and, FIG. 9 is partial sectional view of one end of the housing illustrating another alternate method of installing the bolt in the housing.
Figure 7:
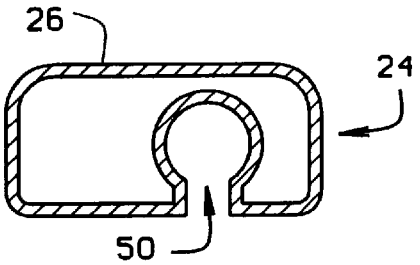
FIG. 7 is a sectional view of the housing taken along line 7—7 in FIG. 5 and representing an alternate housing construction.

All of the movable binder ring sections 22 are commonly mounted on a movable bolt 36 so to move in unison with the bolt. Bolt 36 comprises a rod the length of which corresponds to at least the length of housing 24. A manually operable lever 38 is secured to one end of the bolt. Movement of lever 38 in one direction (clockwise as shown in FIG. 4) rotates bolt 36 to move the binder ring sections 22 rings away from the fixed sections 20 thereof, to open binder 10. Movement of the lever in the opposite direction (counter-clockwise as shown in FIG. 4) brings the movable ring sections back into contact with the fixed sections to close the binder. The movable sections 20 of the binder rings 18 may be integrally formed with bolt 36 so to form a one-piece assembly. Or, the sections can be attached to the bolt by welding or another suitable means of attachment.

Bolt 36 can be mounted in housing 24 in a number of different ways. As shown in the drawings, housing 24 has a plurality of insets 40 formed along its side opposite the side where the fixed sections 20 of the binder rings are attached to the top of the housing. Bolt 36 has sections extending through these insets, these bolts sections being external of the housing. It is on these sections of bolt 36 where the movable portions 22 of the binder rings 18 are formed on the bolt, or are attached to the bolt. Another inset 42 is formed at one end of housing 26, and a notch 44 is formed in top surface 26 of the housing adjacent this inset. Bolt 36 has an end section 46 extending externally of housing 26, inset 42, and lever 38 is formed on, or attached to, this end section of the bolt. A lever arm 48 of lever 38 is received in notch 44 when the lever rotates the bolt to the binder closed position.

Figure 9:
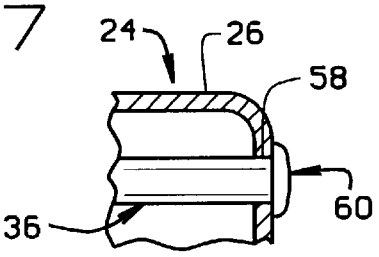
Figure 5:
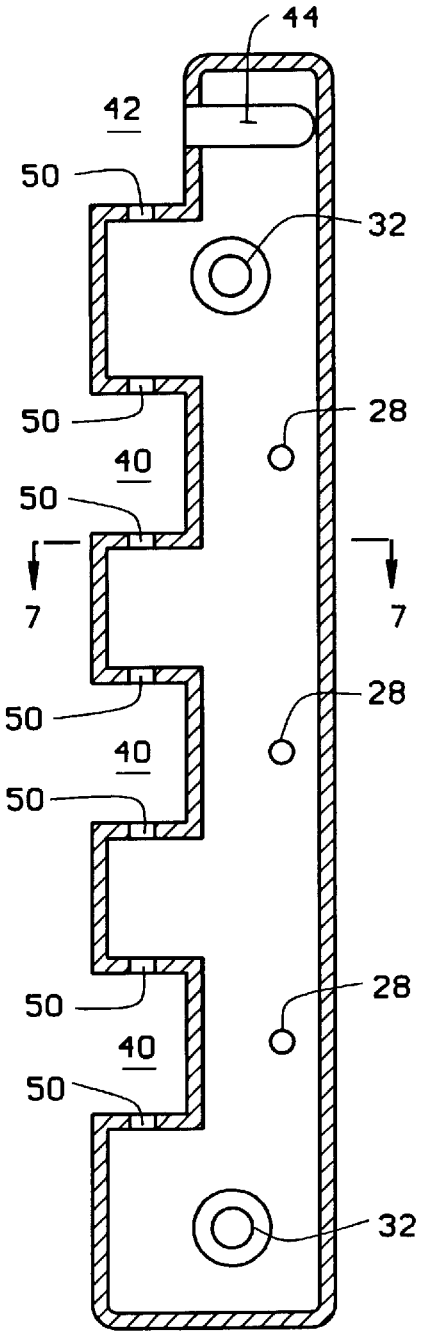
FIG. 5 is a bottom plan of a housing of a binder ring mechanism.

Referring to FIGS. 6–9, various methods of securing bolt 36 to housing 24 of the binder ring mechanism are shown. On each sidewall of the insets 40 and 42 formed in the housing are slotted openings 50 which extend upwardly into the sidewall from the base of the housing openings are sized so bolt 36 can be snap fit into place and still have sufficient freedom to be freely rotatable when opening and closing the binder. To prevent longitudinal movement of the bolt, once the bolt is in place, the bolt may have grooves 52 into which clips 54 are inserted. The grooves would be formed adjacent the inner face of the inset sidewall. Or, spaced rings 56 may be formed on the bolt. Another alternative is to have an opening 58 formed at the opposite end of the housing from inset 42. The end of the bolt opposite the end on which the notch is formed fits through this opening when the bolt is installed. A locking piece (not shown) can be fitted onto this end of the bolt; or, as shown in FIG. 9, this end of the bolt can be spun over so at to be larger in diameter than the opening and so prevent longitudinal movement of the bolt.

What has been described is a ring binder storing hole punched sheets of paper. The binder employs a bolt action mechanism for opening and closing the binder to store and access the paper. A number of binder rings, which capture the paper and hold it in place, each includes a fixed section and a movable section. The movable sections are commonly mounted on a bolt action mechanism for movement of the mechanism to simultaneously move all of the movable binder ring sections. The mechanism, which operates easily and reliably, positively closes the binder rings and does not allow the rings to be pulled apart by forces such as the weight of paper against the rings. Finally, the bolt action mechanism is a low cost, easy to install assembly which is usable with different size ring binders and ring binders having different numbers of binder rings.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A ring binder storing hole punched sheets of paper and the like comprising:

first and second end leafs respectively forming outer covers of the binder;

a plurality of binder rings which hold the sheets in their stored position, each binder ring including a fixed section and a movable section;

a binder ring mechanism positively locking said binder rings to hold the sheets in their stored position against forces tending to open said binder rings, said mechanism including a housing the length of which generally corresponds to the height of the binder, said housing having a top surface to which the fixed sections of the binder rings are affixed and along which they are uniformly spaced;

a movable bolt on which the movable sections of said binder ring are integrally formed to form a one-piece assembly on which said movable sections are commonly mounted and move in unison with the bolt, said bolt being mounted in said housing and extending lengthwise thereof with said housing having a plurality of insets formed therein at locations corresponding to the locations of said binder rings and said bolt having sections extending through said insets externally of said housing with the movable portions of said binder rings being formed on said external bolt sections;

a manually operable lever secured to one end of the bolt, movement of the lever in one direction rotating the bolt to move the movable sections of the binder rings away from the fixed sections thereof to open the binder and movement of the lever in the opposite direction bringing the movable sections back into contact with the fixed sections to close the binder, said housing further including an inset formed at one end thereof and a notch formed in said top surface of said housing adjacent said end formed inset, said bolt having an end section extending externally of said housing at said end formed inset, said lever being secured to said bolt at said end section of said bolt, and said lever having a lever arm receivable in said notch when said lever rotates said bolt to a binder closed position; and, clips clippable onto said bolt to secure said bolt in said housing.

2. A ring binder storing hole punched sheets of paper and the like comprising:

first and second end leafs respectively forming outer covers of the binder;

a plurality of binder rings which hold the sheets in their stored position, each binder ring including a fixed section and a movable section;

a binder ring mechanism positively locking said binder rings to hold the sheets in their stored position against forces tending to open said binder rings, said mechanism including a housing the length of which generally corresponds to the height of the binder, said housing having a top surface to which the fixed sections of the binder rings are affixed and along which they are uniformly spaced;

a movable bolt on which the movable sections of said binder ring are integrally formed to form a one-piece assembly on which said movable sections are commonly mounted and move in unison with the bolt, said bolt being mounted in said housing and extending lengthwise thereof with said housing having a plurality of insets formed therein at locations corresponding to the locations of said binder rings and said bolt having sections extending through said insets externally of said housing with the movable portions of said binder rings being formed on said external bolt sections;

a manually operable lever secured to one end of the bolt, movement of the lever in one direction rotating the bolt to move the movable sections of the binder rings away from the fixed sections thereof to open the binder and movement of the lever in the opposite direction bringing the movable sections back into contact with the fixed sections to close the binder, said housing further including an inset formed at one end thereof and a notch formed in said top surface of said housing adjacent said end formed inset, said bolt having an end section extending externally of said housing at said end formed inset, said lever being secured to said bolt at said end section of said bolt, and said lever having a lever arm receivable in said notch when said lever rotates said bolt to a binder closed position; and, rings formed on said bolt for securing said bolt in said housing.

3. In a ring binder storing hole punched sheets of paper, a binder ring mechanism comprising a housing the length of which generally corresponds to the height of the binder, a plurality of binder rings each of which includes a fixed section and a movable section, said housing having a top surface to which and said fixed sections are affixed and spaced uniformly along one side thereof, and bolt means positively locking said binder rings to hold the sheets in their stored position against forces tending to open said binder rings, said bolt means including a bolt mounted in said housing and extending lengthwise thereof and on which all of said movable binder ring sections are commonly mounted so to move in unison with movement of the bolt, said movable sections being integrally formed with said bolt to comprise a one-piece assembly, said housing having a plurality of insets formed therein at locations corresponding to the locations of said binder rings, said bolt having sections extending through said insets externally of said housing with the movable portions of said binder rings being formed on said external bolt sections, a manually operable lever secured to one end of the bolt, movement of the lever rotating the bolt to move the movable sections of the binder rings away from the fixed sections thereof to open the binder, and movement of the lever in the opposite direction bringing the movable sections back into contact with the fixed sections to close the binder, an inset formed at one end of said housing and a notch formed in said top surface of said housing adjacent said end formed inset, said bolt having an end section extending externally of said housing at said end formed inset, said lever being secured to said bolt at said end section of said bolt, and said lever having a lever arm receivable in said notch when said lever rotates said bolt to a binder closed position, and clips clippable onto said bolt to secure said bolt in said housing.

4. In a ring binder storing hole punched sheets of paper, a binder ring mechanism comprising a housing the length of which generally corresponds to the height of the binder, a plurality of binder rings each of which includes a fixed section and a movable section, said housing having a top surface to which and said fixed sections are affixed and spaced uniformly along one side thereof, and bolt means positively locking said binder rings to hold the sheets in their stored position against forces tending to open said binder rings, said bolt means including a bolt mounted in said housing and extending lengthwise thereof and on which all of said movable binder ring sections are commonly mounted so to move in unison with movement of the bolt, said movable sections being integrally formed with said bolt to comprise a one-piece assembly, said housing having a plurality of insets formed therein at locations corresponding to the locations of said binder rings, said bolt having sections extending through said insets externally of said housing with the movable portions of said binder rings being formed on said external bolt sections, a manually operable lever secured to one end of the bolt, movement of the lever rotating the bolt to move the movable sections of the binder rings away from the fixed sections thereof to open the binder, and movement of the lever in the opposite direction bringing the movable sections back into contact with the fixed sections to close the binder, an inset formed at one end of said housing and a notch formed in said top surface of said housing adjacent said end formed inset, said bolt having an end section extending externally of said housing at said end formed inset, said lever being secured to said bolt at said end section of said bolt, and said lever having a lever arm receivable in said notch when said lever rotates said bolt to a binder closed position, and rings formed on said bolt to secure said bolt in said housing.

5. In a ring binder storing hole punched sheets of paper and the like, the binder ring including a plurality of rings for holding the sheets in their stored position with each binder ring including a fixed section and a movable section, a housing having an outer surface on which fixed sections of the binder rings are affixed, the improvement comprising;

a movable bolt on which the movable sections of the binder rings are commonly mounted, said bolt extending through said housing which has a plurality of insets formed therein at locations corresponding to locations of said binder rings, and said bolt having sections extending through said insets externally of said housing with the movable portions of said binder rings being formed on said external bolt sections; and, clips clippable onto said bolt to secure said bolt in said housing.

6. The improvement of claim 5 further including a manually operable lever secured to one end of the bolt to move the movable sections of the binder rings relative to the fixed sections thereof to open and close the binder.

7. The improvement of claim 6 wherein said housing a notch formed in said outer surface and said lever has a lever arm receivable in said notch when said lever rotates said bolt to close said binder.

8. In a ring binder storing hole punched sheets of paper and the like, the binder ring including a plurality of rings for holding the sheets in their stored position with each binder ring including a fixed section and a movable section, a housing having an outer surface on which fixed sections of the binder rings are affixed, the improvement comprising;

a movable bolt on which the movable sections of the binder rings are commonly mounted, said bolt extending through said housing which has a plurality of insets formed therein at locations corresponding to locations of said binder rings, and said bolt having sections extending through said insets externally of said housing with the movable portions of said binder rings being formed on said external bolt sections; and, rings formed on said bolt to secure said bolt in said housing.

9. The improvement of claim 8 further including a manually operable lever secured to one end of the bolt to move the movable sections of the binder rings relative to the fixed sections thereof to open and close the binder.

10. The improvement of claim 9 wherein said housing a notch formed in said outer surface and said lever has a lever arm receivable in said notch when said lever rotates said bolt to close said binder.

11. The ring binder of claim 1 or 2 wherein said housing has an opening in said end opposite said end formed inset, an end of said bolt being insertable through said opening, and means for securing said end of said bolt in place to secure said bolt in said housing.

12. The mechanism of claim 3 or 4 wherein said housing has an opening in said end opposite said end formed inset, an end of said bolt being insertable through said opening, and means for securing said end of said bolt in place to secure said bolt in said housing.

* * * * *